US007549637B2

(12) United States Patent
Lease

(10) Patent No.: US 7,549,637 B2
(45) Date of Patent: Jun. 23, 2009

(54) PYRAMID ROULETTE

(76) Inventor: Todd Richard Lease, 55 Maple Ave., Walnut Bottom, PA (US) 17266

( * ) Notice: Subject to any disclaimer, the term of this patent is extended or adjusted under 35 U.S.C. 154(b) by 0 days.

(21) Appl. No.: 11/124,047

(22) Filed: May 9, 2005

(65) Prior Publication Data

US 2006/0249899 A1 Nov. 9, 2006

(51) Int. Cl.
*A63B 71/00* (2006.01)

(52) U.S. Cl. ..... 273/142 H

(58) Field of Classification Search ..... 273/142 H
See application file for complete search history.

(56) References Cited

U.S. PATENT DOCUMENTS

| | | | | |
|---|---|---|---|---|
| 848,351 | A * | 3/1907 | DeWalt | 273/244.1 |
| 1,659,959 | A * | 2/1928 | Rockwood | 273/245 |
| 3,989,252 | A | 11/1976 | Mattson | |
| 4,077,623 | A * | 3/1978 | Clausell | 482/24 |
| 4,077,631 | A | 3/1978 | Tela | |
| 4,206,921 | A * | 6/1980 | Luehr | 273/142 D |
| 4,337,945 | A | 7/1982 | Levy | |
| 4,396,193 | A * | 8/1983 | Reinhardt et al. | 463/22 |
| 4,601,470 | A * | 7/1986 | Kadota et al. | 273/142 E |
| 5,207,432 | A * | 5/1993 | Miller | 473/465 |
| 5,437,452 | A | 8/1995 | Graf et al. | |
| 5,553,851 | A * | 9/1996 | Malavazos et al. | 273/142 E |
| 5,636,838 | A * | 6/1997 | Caro | 273/142 E |
| 5,755,440 | A | 5/1998 | Sher | |
| 5,934,999 | A * | 8/1999 | Valdez | 463/17 |
| 6,042,114 | A * | 3/2000 | Phillip | 273/142 R |
| 6,047,965 | A | 4/2000 | Mollo et al. | |
| 6,209,869 | B1 | 4/2001 | Mathews | |
| 6,302,395 | B1 * | 10/2001 | Astaneha | 273/274 |
| 6,467,770 | B1 | 10/2002 | Matosevic | |
| 2001/0035605 | A1 * | 11/2001 | Jones | 273/144 R |
| 2002/0163124 | A1 * | 11/2002 | Weigl | 273/142 R |
| 2002/0167126 | A1 * | 11/2002 | Herman De Raedt et al. | 273/142 E |
| 2003/0036426 | A1 * | 2/2003 | ungaro et al. | 463/27 |
| 2003/0125109 | A1 * | 7/2003 | Green | 463/29 |
| 2003/0232651 | A1 * | 12/2003 | Huard et al. | 463/42 |
| 2004/0195771 | A1 * | 10/2004 | Huard et al. | 273/274 |
| 2004/0198484 | A1 * | 10/2004 | Johnson | 463/17 |
| 2004/0256804 | A1 * | 12/2004 | Huard et al. | 273/292 |
| 2005/0032570 | A1 * | 2/2005 | Ohira | 463/17 |
| 2005/0167912 | A1 * | 8/2005 | Sokolov | 273/142 R |
| 2005/0288089 | A1 * | 12/2005 | Cammegh et al. | 463/17 |
| 2006/0009274 | A1 * | 1/2006 | Finocchio | 463/17 |
| 2006/0046837 | A1 * | 3/2006 | Ito et al. | 463/22 |

* cited by examiner

*Primary Examiner*—Gene Kim
*Assistant Examiner*—Dolores Collins
(74) *Attorney, Agent, or Firm*—Stephen R. Yoder, Esq.

(57) ABSTRACT

A roulette-type game apparatus with a non-traditional style. A non-traditional resilient indicator is introduced in the game from above two independently rotating disks. The indicators are dropped through a delivery tube onto an elevated surface. The indicators bounce, from that surface and strike the enclosure, then finally strike the rotating disks which contain indicia and corresponding pockets. The indicators bounce around until they come to rest in a pocket, resulting in a randomly selected winning numbers, number combos, or progressive number. All bets are placed on a table. The game apparatus would have some similar bets as roulette with additional chances to win such as a dual indicator outcome similar to a two die outcome in craps, including a chance to win a progressive jackpot.

20 Claims, 7 Drawing Sheets

PYRAMID ROULETTE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISK

Not Applicable

BACKGROUND OF THE INVENTION

1. Field of Invention

The present invention generally relates to games of chance and, more particularly, to a roulette game in which the layout is altered from the original game in that there is a plurality of indicia and corresponding pockets on the roulette wheel which consists of a plurality of independently rotating disks and a plurality of indicators released onto an elevated surface producing a more randomized result.

2. Description of Prior Art

Roulette is a very popular game of chance played in casinos throughout the world. The roulette player enjoys a wide variety of betting options and the possibility of getting large payouts. Conventional roulette is played using a roulette wheel with indicia and pockets along the periphery of the wheel. The wheel is turned in one direction and the indicator ball is rolled in the opposite direction in a fixed channel surrounding the rotatable wheel. As the speed of the ball slows, the indicator ball comes to rest in one of the pockets and the indicia and color thereof is compared to the betting area to determine the various payouts.

One of the concerns with conventional roulette is the ability of the operator of the wheel to predetermine where the indicator ball will fall. This ability may favor either the player who is working with the operator to get a larger payout or the casino who wants to prevent players from winning the large payouts. It is desirable to randomize the indicated indicia. Mollo, U.S. Pat. No. 6,047,965, introduces air outputs in the roulette bowl to randomize the travel of the indicator ball. Jones, U.S. Patent Application 2001/0035605, seeks to improve the randomized selection of numbers by introducing a ball blower and a lottery-like numbered ball selector. Another way to randomize the travel of the indicator ball is to introduce the indicator ball from above the roulette wheel onto an elevated rotating surface. The indicator ball is made of a resilient material that will bounce off the rotating surface and strike the walls of an enclosure designed to direct the indicator ball toward the roulette wheel. An enclosure was used in Luehr, U.S. Pat. No. 4,206,921, to retain the indicators within the game while randomizing the result by sequentially turning over the complete game. Unlike Luehr, the present invention introduces the ball through the enclosure giving motion to the indicator by dropping it from above the spinning disks while the enclosure remains stationary.

In traditional roulette the pocket dividers rise above the top of the pocket acting as a paddle to strike the ball and change its direction. The present invention introduces wide bridge-like dividers that allow the indicator ball to roll from one disk to another. This wide surface also provides a way to redirect the motion of the ball when striking the surface from above. These dividers are tapered into each pocket providing an escape for the moving indicator.

Another draw for players is the large payout. In addition to randomizing the travel of the indicator ball, the present invention offers the player many additional betting opportunities and offers a larger payout. Caro, U.S. Pat. No. 5,636,838, describes a roulette wheel consisting of two disks that may turn in opposite directions. This invention depends on the use of an alignment mechanism because there is only one ring of pockets in the game. That invention presented without an alignment mechanism would not provide an adequate result. By adding pockets and indicia on each rotatable carrier the final result is an increase in betting options and ultimately a higher payout for a particular bet.

BRIEF SUMMARY OF THE INVENTION

The present invention is a new game of chance using a plurality of enclosed disks and introducing a plurality of indicators from above the disks. In the preferred embodiment there are two disks. The disks are numbered one through fifty and colored red or black, alternating the numbers and colors between the two wheels, including a 0 and 00 which are green, as is customary in U.S. roulette wheels. The indicators settle in pockets representing a specific number and color, thus indicating the randomized result. The present invention includes a betting area and a progressive jackpot. The present invention provides the look of roulette and lottery and it increases the betting opportunities by adding craps-like play.

DETAILED DESCRIPTION OF THE INVENTION

Figure 1:
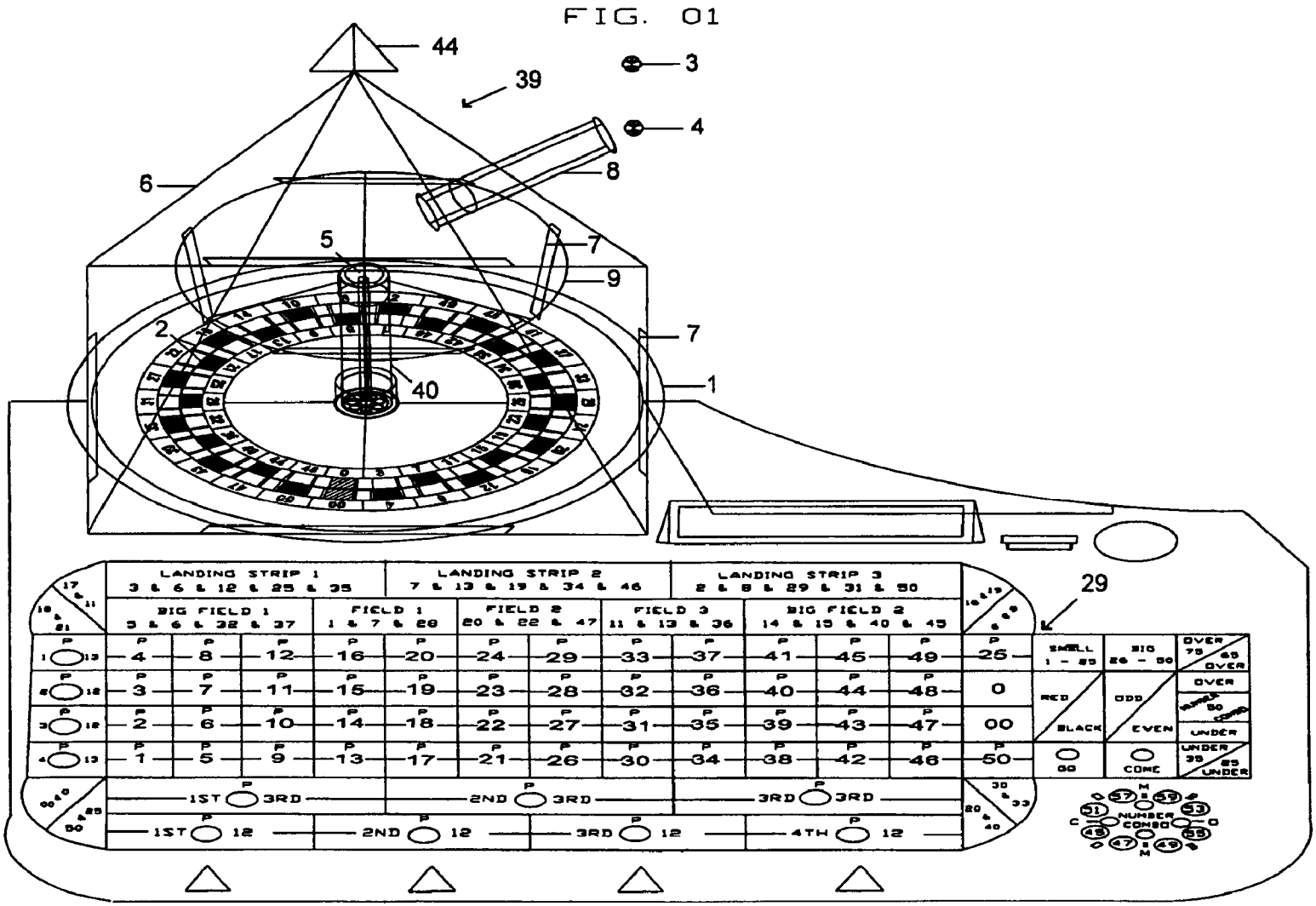
FIG. 1 is an elevated top front view of the roulette-type apparatus adjacent to the betting area.
Figure 2:
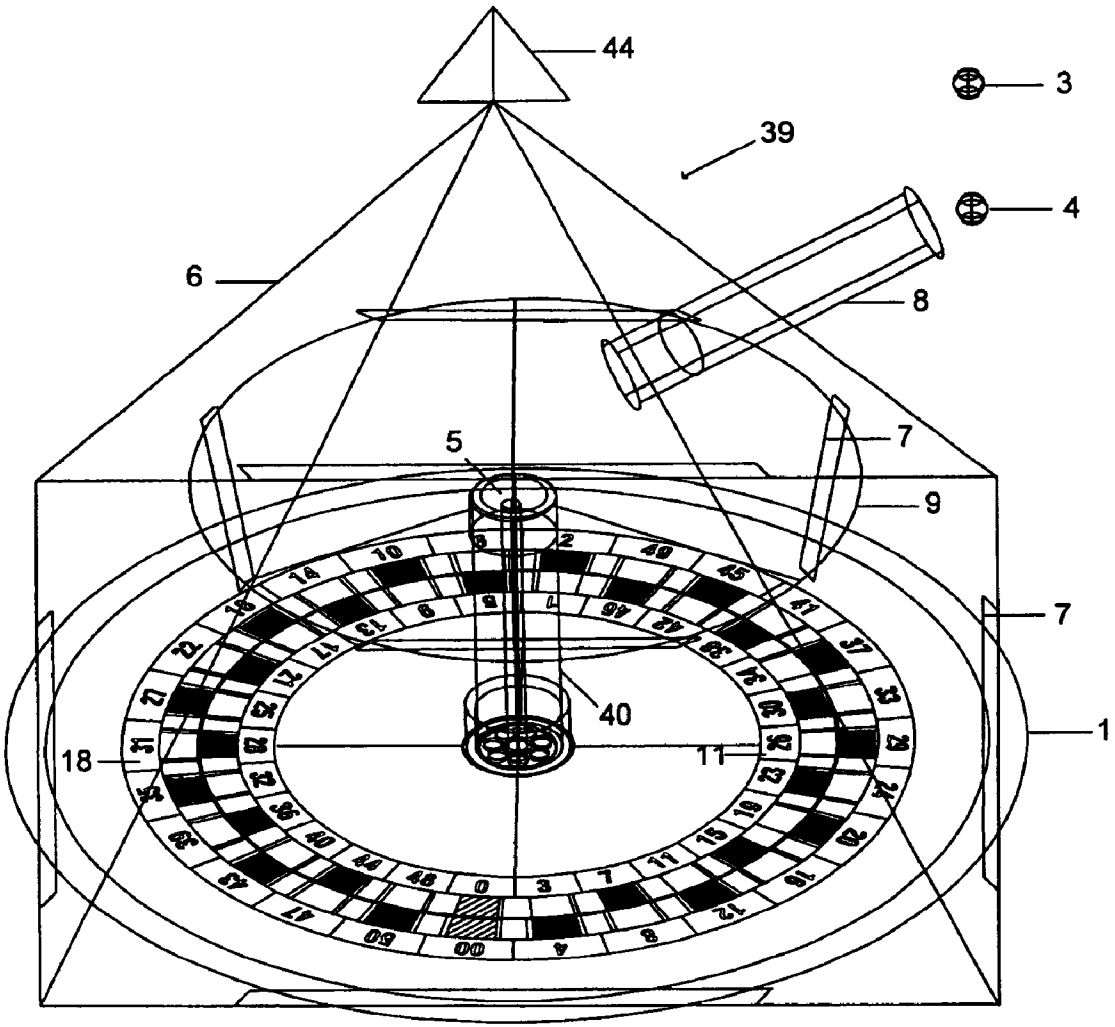
FIG. 2 is an elevated top front view of the apparatus, showing the enclosure and the two disks.
Figure 3:
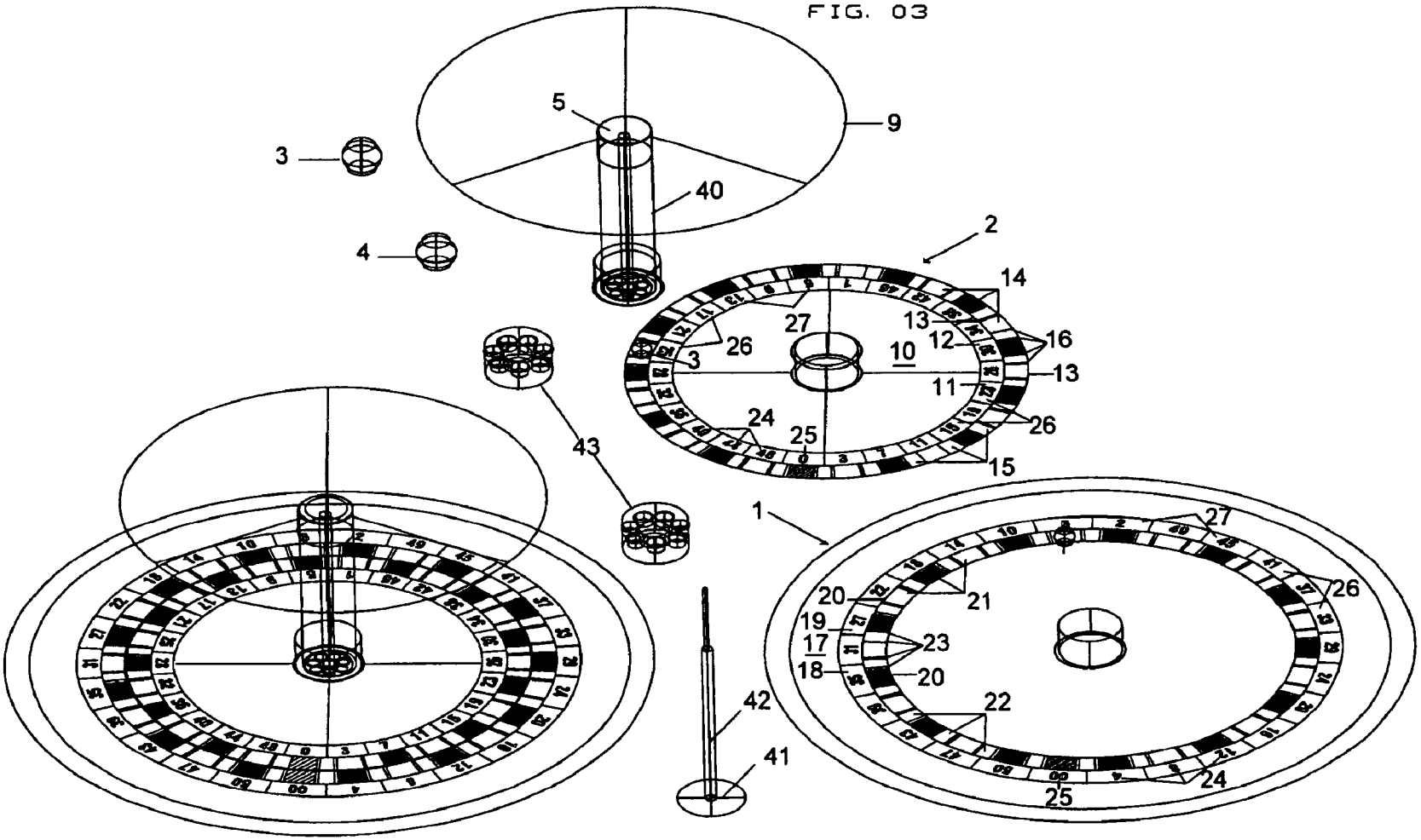
FIG. 3 is an elevated top front view of the two disks both assembled and exploded.
Figure 4:
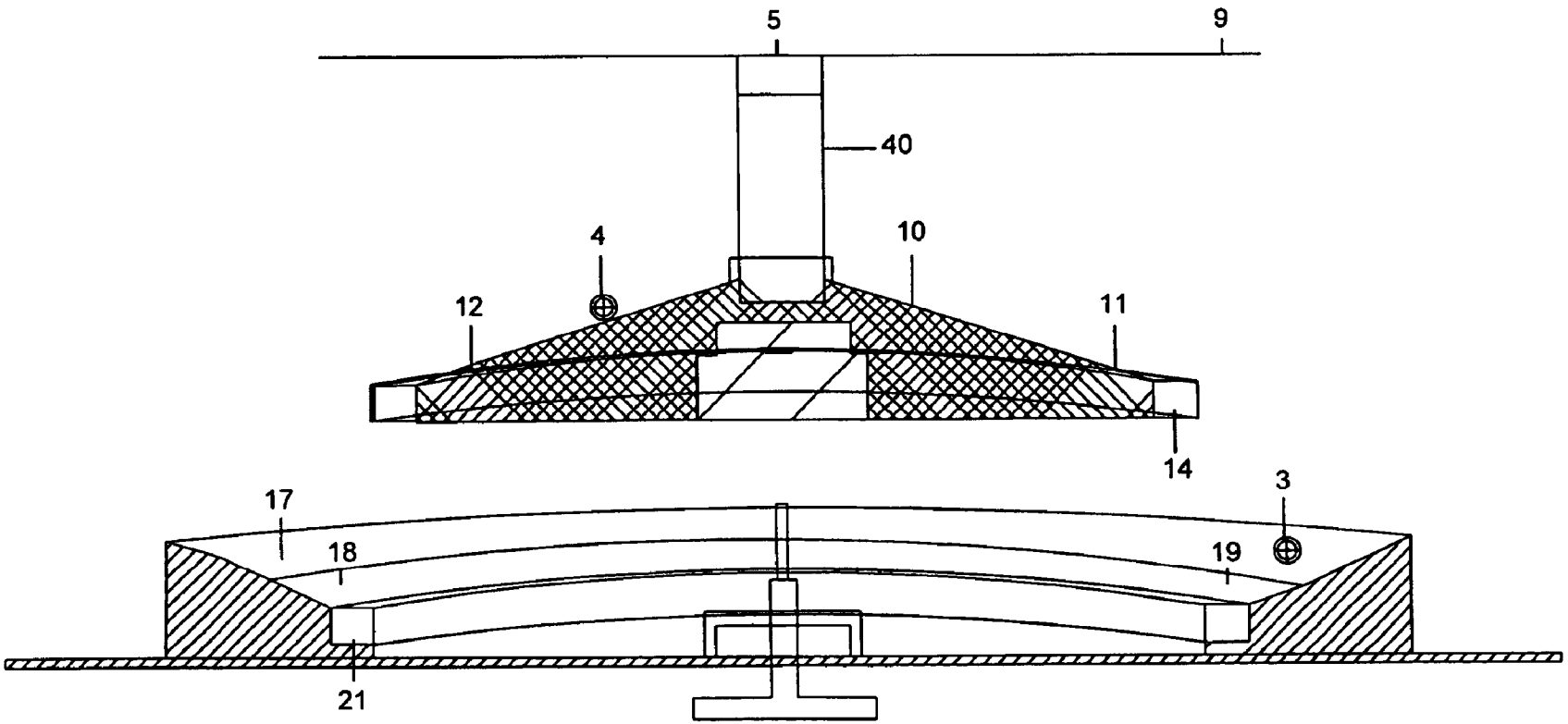
FIG. 4 is an exploded cross-sectional side view of the two-disk assembly.
Figure 5:
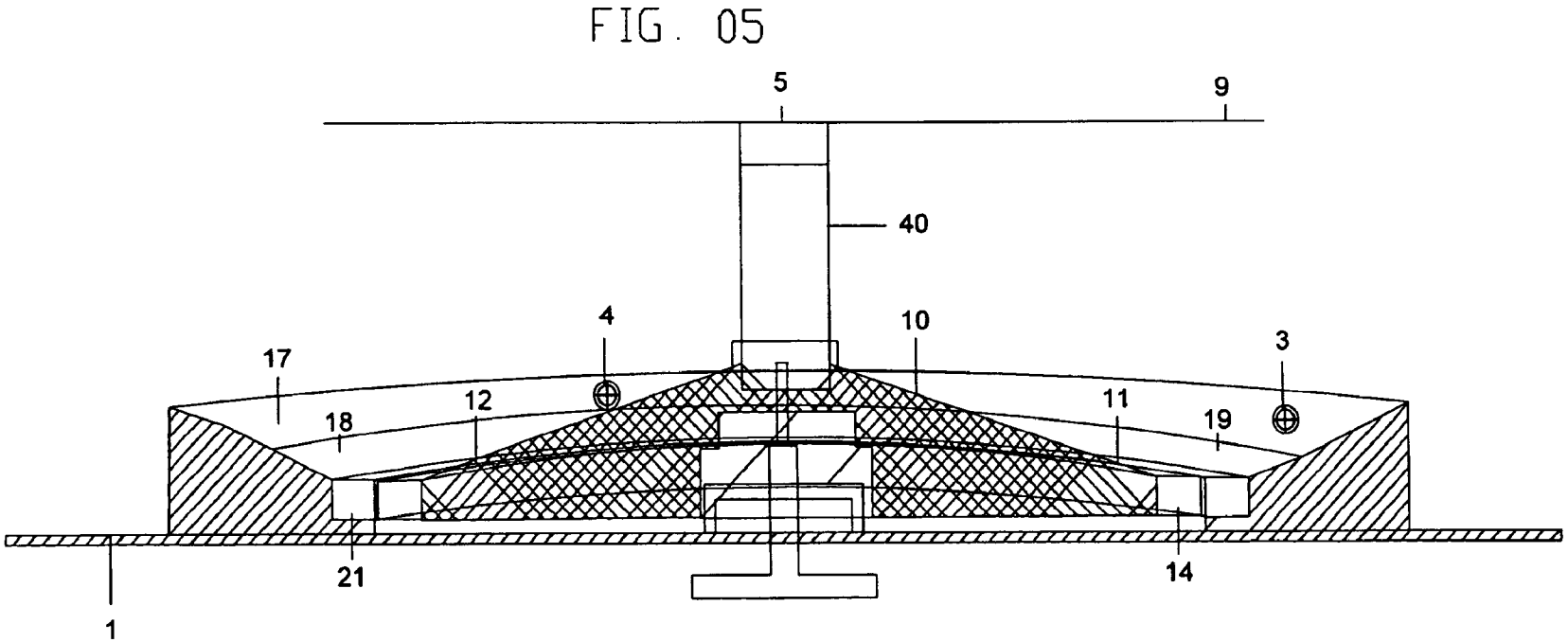
FIG. 5 is an assembled cross-sectional side view of the two disks.
Figure 6:
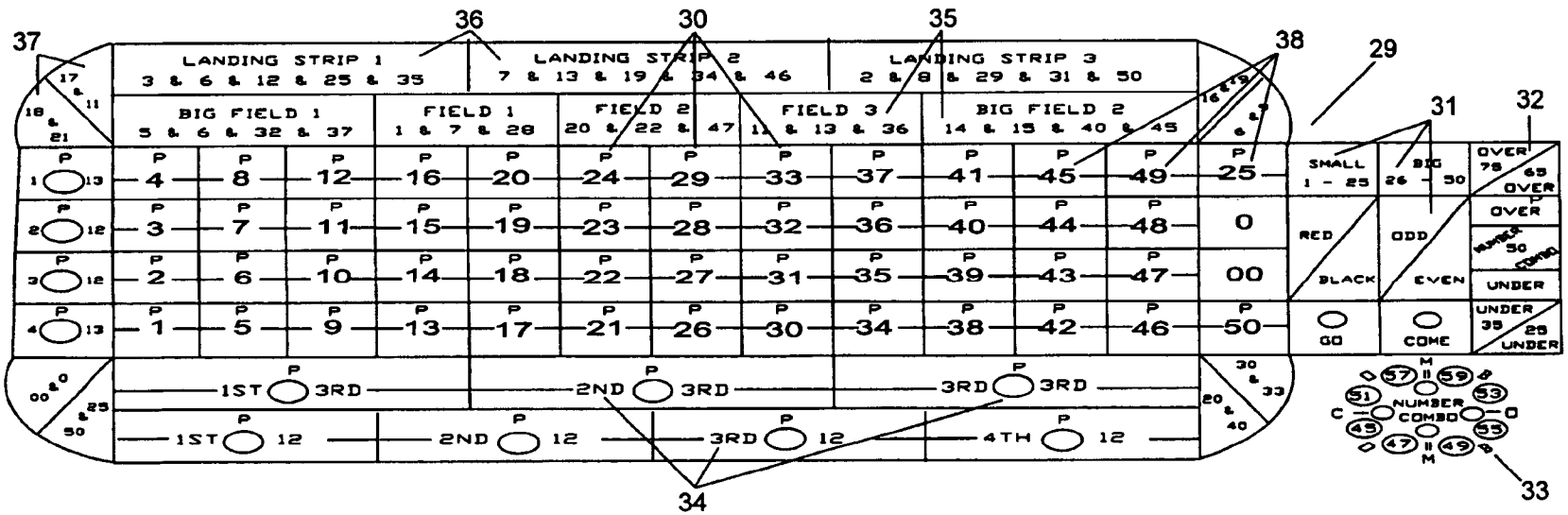
FIG. 6 is a top view of the betting area.

FIG. 1 shows a roulette-type game apparatus with a non-traditional roulette wheel arrangement 39 and a corresponding betting area 29. As shown in FIG. 2, the preferred embodiment of this game uses two disks 1 and 2, two resilient indicator balls 3 and 4, and a rotatable elevated circular surface 5, centrally located. FIG. 6 shows the wire frame ring 9 adjacent to the elevated surface 5. This assembly is centrally located in the inner disk 2 and moves with the inner disk 2. As shown in FIG. 2, the transparent enclosure 6 provides access 7 to manually rotate each of the two disks 1 and 2. A transparent delivery tube 8 provides for the introduction of the indicator balls 3 and 4 and directs the indicator balls such that they bounce off of the elevated surface 5. The elevated surface 5 is adjacent to a wire frame ring 9 that is accessible outside the enclosure 6. The elevated surface 5 may be textured to further influence the speed and direction of the indicator balls 3 and 4.

The preferred embodiment of the game has two indicator balls; the table ball 3 and the progressive ball 4. The indicator balls 3 and 4 are identifiable as the table ball 3 or the progressive ball 4 by their distinct color. The indicator balls 3 and 4 are kept in play after bouncing from the elevated surface 5 by the enclosure 6 which, in its preferred embodiment is shaped like a pyramid to vary the distance from the discs to a striking surface.

Referring to FIGS. 14*a* and 14*b*, the inner disk 2 is made up of three sections, the innermost area is a convex surface region 10 occupying 50% of the disk's surface at a 70° angle and encircled by an adjacent chamfered region 11 occupying 4% of the disk's surface at a 65° angle with colored numbered sections 12 laid out in this region 11. Adjacent to the chamfered region 11 is the pocketed ring 13 along the periphery of the inner disk 2. The pockets 14 are a depth of ½ the diameter of the indicator balls. The width of the pockets 14 on the inner disk 2 is 1¼ times the diameter of the indicator balls 3 and 4. The length of the pockets 14 is 1½ times the diameter of the indicator balls 3 and 4. The pocketed ring 13 includes wide bridge-like dividers 15 which act as ramps. The dividers 15 are tapered to provide a sloped surface 16 for the indicator balls 3 and 4 to escape the rotating pockets 14 more easily than in the common roulette arrangement.

The outer disk 1 is made up of three sections, an outer concave surface region 17 occupying 8% of the disk's surface at a 60° angle which encircles an adjacent chamfered region 18 occupying 4% of the disk's surface at a 65° angle with colored numbered sections 19 laid out in this region 18. Adjacent to the chamfered region 18 is the pocketed ring 20 along the inside edge of the disk. The pockets 21 have a depth of ½ the diameter of the indicator balls 3 and 4. The width of the pockets 21 is 1½ times the diameter of the indicator balls 3 and 4. The length of the pockets 21 is 1¾ times the diameter of the indicator balls 3 and 4. The pocketed ring 20 includes wide bridge-like dividers 22 acting as ramps. The dividers 22 are tapered to provide a sloped surface 23 for the balls to escape the pockets 21 more easily than the common roulette arrangement.

In the preferred embodiment, each disk 1 and 2 has twenty-five unique numbers 24 and one of the numbers "0" or "00" 25 making twenty-six total indicia per disk. The desired number placement on the disk is achieved by placing the sequential numbers every thirteen spaces. The numbers 24 are placed around the disks 1 and 2 in a counter clockwise manner, alternating the numbers between the two disks. The numbers 24 are placed on the two disks 1 and 2 with the bottom of the numbers 24 facing the pockets 14 and 21. Each disc 1 and 2 has odd and even numbers 24. The numbers 24 on the inner disk 2 are odd up to and including the number 25. After 25, the numbers are even. The outer disk 1 is even up to and including the number 24. After 24, the numbers beginning with 27 are odd. Color placement on the inner disk 2 is alternated between red 26 and black 27 except for the green 25 "0". Color placement on the outer disk 1 is alternated between black 26 and red 27 except for the green 25 "00".

Figure 7B:
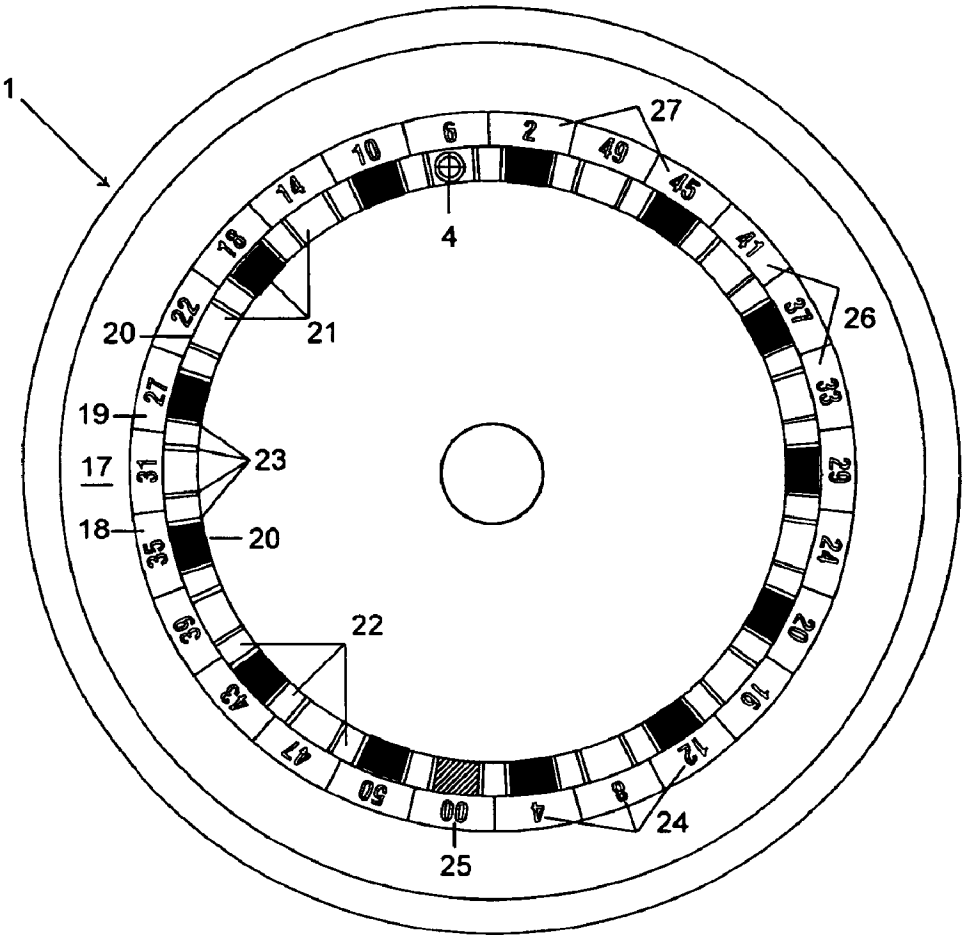
FIG. 7 is a top view of the two disks separated showing numbers in relation to colors.
Figure 7A:
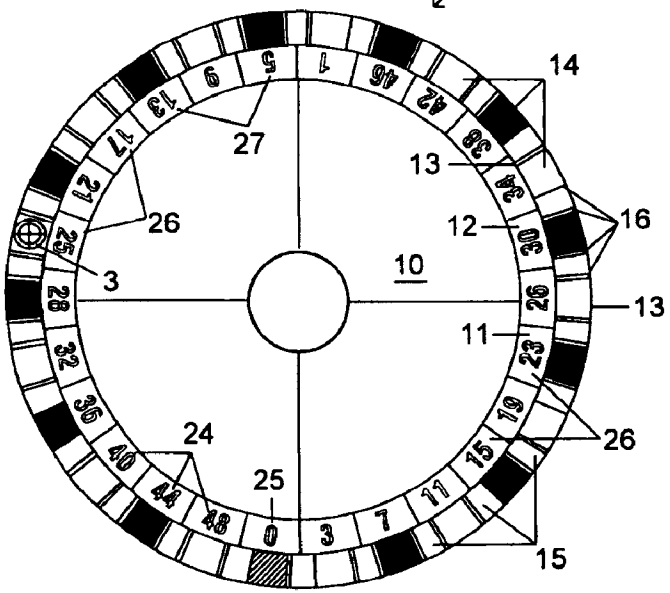

FIGS. 6, 7, and 8 present the assembly. The elevated surface 5 with the adjacent wire frame ring 9 is supported by a cylinder 40 extending from the inner disk 2. The two disks 1 and 2 are supported by a pedestal foot 41 and centrally located axle 42. The two disks 1 and 2 rotate on roller bearings 43, the use of which is well known in the art. The enclosure 6, best shown in FIG. 2, includes a delivery tube 8 which passes through a wall of the enclosure 6 and is positioned to allow the indicator balls 3 and 4 to strike the elevated surface 5. The construction of the disks and assembly of the apparatus may be accomplished using methods well known in the art.

The present invention teaches a game that is different from traditional roulette. In the preferred method of play, a timed sequence expressed by colored lights 44 controls the pace of the game. The inner disk 2 is spun in either a clockwise or counter clockwise direction and the outer disk 1 is spun in the opposite direction. The indicator balls 3 and 4 are dropped in a timed sequence into the game from above through the delivery tube 8 where the indicator balls 3 and 4 are directed onto the elevated surface 5 extending from and rotating with the inner disk 2. The indicator balls 3 and 4 are then directed to the walls of the enclosure 6 and finally strike one of the two rotating disks 1 and 2. The bridge-like dividers 22 allow the balls 3 and 4 to travel across providing bridges from one disk to the next. The wide bridge-like dividers 22 provide a surface for deflecting the travel of the indicator balls 3 and 4 back toward the enclosure 6. The indicator balls 3 and 4 may have a solid or liquid core to vary the action of the game. There is lots of randomized movement of the indicator balls 3 and 4 prior to settling into a pocket 14 or 21 indicating the randomized number 12 or 24 and color 26, 27, or 25 selection.

The present invention has a betting area 29. See FIG. 10. A player may bet on odd, even, red or black, big or small, come or go 31. A combo bet of over or under 32 requires adding the indicated numbers shown by both the table ball 3 and the progressive ball 4. A player may also bet on a combo number of 45 47 49 51 53 55 57 59 (33) or bet on two of the combo numbers at a time designated by the chip placement on a c, o, m, b, or o (33). A player may bet on a number combo spot, betting on four combo numbers at a time. A player may place a bet on the first twelve, second twelve, third twelve, forth twelve, first third, second third, or third 34. A bet may also be placed on the O area indicating the table ball 3 or progressive ball 4. A player may bet a field 35 which has three numbers per bet, a big field which has four numbers per bet, a landing strip 36 which has five numbers per bet, or a table corner 37 which has two numbers per bet. A player may make a table number bet by betting on a single number between 1 and 50 or the 0's 38. Bets may also be made on both the table ball 3 and the progressive ball 4 at the same time by placing a bet on the number between the progressive number 30 and the table number 38.

The invention claimed is:

1. A roulette-type game apparatus comprising:

a support structure;

an enclosure having a pyramid shape, said enclosure having a plurality of faces, each of said plurality of faces being transparent, said enclosure having at least one first slot, said enclosure having at least one second slot;

a first disk having a first diameter, said first disk rotatably supported on said support structure, said first disk being enclosed by said enclosure, said first disk being rotatable about an axis of rotation, said first disk having a plurality of first depressions, each of said plurality of first depressions being formed by a plurality of first walls attached to said first disk, each of said plurality of first depressions being marked with one of a first plurality of indicia, an edge of said first disk protruding through said at least one first slot, whereby said first disk is rotatable by hand from outside said enclosure;

a second disk rotatably supported on said support structure, said second disk being enclosed by said enclosure, said second disk being rotatable about said axis of rotation, said second disk rotating independent of said first disk, said second disk having a second diameter, said second diameter being smaller than said first diameter, said second disk positioned over a central portion of said first disk, said second disk being a size small enough to expose said plurality of first depressions, said second disk having a plurality of second depressions, each one of said plurality of second depressions being formed by a plurality of second walls attached to said second disk, each one of said plurality of second depressions being marked with one of a second plurality of indicia;

a plurality of indicators;

a protrusion extending away from said second disk, said protrusion having a first end and a second end, said protrusion attached at said first end to said second disk, said second end having a surface dimensioned and configured to rebound said plurality of indicators;

a ring attached to said second end of said protrusion, said ring being circular having a plurality of members extending radially from said second end of said protrusion to said ring, a portion of said ring protruding through said at least one second slot in said enclosure, whereby said ring and said protrusion and said second disk are collectively rotatable by hand from outside said enclosure; and a delivery tube communicating with said enclosure, said delivery tube dimensioned and configured to transfer said plurality of indicators through said enclosure from above said first and second disks, said delivery tube directing said plurality of indicators toward said axis of rotation onto said second end of said protrusion, whereby each one of said plurality of indicators becomes associated with one of said first plurality of indicia or one of said second plurality of indicia upon being introduced into said enclosure.

2. The apparatus according to claim 1 wherein each one of said plurality of indicators is constructed to rebound when striking a random surface within said enclosure.

3. The apparatus according to claim 1 further including a betting area associated with said first plurality of indicia and said second plurality of indicia.

4. The apparatus of claim 1 wherein at least two opposing ones of said plurality of first walls forming said plurality of first depressions on said first and second disks are inclined planes.

5. The apparatus of claim 1 wherein each pair of said plurality of first depressions are bridged by a plateau, said plateau being a planar surface.

6. The apparatus of claim 1 wherein each pair of said plurality of second depressions are spaced apart by a plateau, said plateau being a planar surface, said plateau being interposed between each one of said plurality of second depressions.

7. The apparatus of claim 1 wherein for each one of said at least one first slot there is a corresponding one of said plurality of faces of said enclosure, each one of said plurality of faces having one of said at least one first slots.

8. The apparatus of claim 1 wherein for each one of said at least one second slot there is a corresponding one of said plurality of faces of said enclosure, each one of said plurality of faces having one of said at least one second slots.

9. A roulette-type game apparatus comprising:

a first disk having a first diameter, said first disk being rotatable about an axis of rotation, said first disk having a plurality of first depressions, each one of said plurality of first depressions dimensioned and configured to receive a ball, said plurality of first depressions associated with a plurality of first indicia;

a second disk, said second disk being rotatable about said axis of rotation, said second disk being independently rotatable about said axis of rotation, said second disk positioned over a first central portion of said first disk, said second disk having a second diameter smaller than said first diameter, said second disk being a size small enough to expose said plurality of first depressions, said second disk having a plurality of second depressions, each one of said plurality of second depressions dimensioned and configured to receive the ball, said plurality of second depressions associated with a plurality of second indicia;

a protrusion positioned over a second central portion of said second disk, said protrusion having a first end and a second end, said protrusion attached at said first end to said second disk;

an enclosure containing said first disk and said second disk, said enclosure having at least one first slot, said enclosure having at least one second slot, said enclosure configured to contain the ball within said enclosure, said enclosure having an opening configured to receive the ball into an interior space of said enclosure such that the ball is positioned to strike said second end of said protrusion after being received through said opening, and edge of said first disk protruding through said at least one first slot; and a frame attached to said second end of said protrusion, said frame being circular, said frame having a plurality of elongated members extending radially from said second end to said frame, a portion of said frame protruding through said at least one second slot in said enclosure, whereby said frame and said protrusion and said second disk are collectively rotatable by hand.

10. The apparatus of claim 9, further including a plurality of balls configured to rebound after striking a surface inside said enclosure.

11. The apparatus of claim 9 wherein said enclosure is a pyramid shape.

12. The apparatus of claim 9 wherein said second end of said protrusion is a surface dimensioned and configured for rebounding the ball.

13. The apparatus of claim 9 wherein at least two opposing ones of said plurality of second walls forming said plurality of second depressions are inclined planes.

14. The apparatus of claim 9 wherein said enclosure further includes at least one transparent wall.

15. The apparatus of claim 9 wherein each of said plurality of first depressions has a depth substantially one-half of the diameter of the ball.

16. A method of playing a game comprising the steps of:

a) spinning a first disk by urging a portion of said first disk that protrudes through a first slot of an enclosure, said first disk having a plurality of first depressions being associated with a plurality of first indicia;

b) spinning a ring by urging a portion of said ring that protrudes through a second slot of said enclosure, said ring causing a second disk smaller than said first disk to rotate, said second disk being located above said first disk, said second disk being coaxial with said first disk, said second disk rotating independently of said first disk, said second disk having a plurality of second depressions being associated with a plurality of second indicia;

c) releasing a plurality of balls through a delivery tube, said delivery tube passing through said enclosure containing said first and said second disks;

d) waiting for said plurality of balls to indicate an indicia after said step of releasing a plurality of balls, said indicia being indicated when each one of said plurality of balls remains positioned in any one of said plurality of first or second depressions; and e) identifying said indicated indicia.

17. The method of claim 16 further including a first step of placing a bet on a betting area wherein each possible indicated indicia is identified.

18. The method of claim 16 further including after step (e) the step of providing a payout for the association of a plurality of indicated indicia.

19. The method of claim 16 further including the steps of generating lighting effects before any one of the steps including (a)-(e) of claim 16.

20. The method of claim 16 wherein said delivery tube in step (c) directs said plurality of balls toward an end of a protrusion extending along a rotating axis of said second disk.

* * * * *